US007347256B1

(12) United States Patent
Eggleston

(10) Patent No.: US 7,347,256 B1
(45) Date of Patent: Mar. 25, 2008

(54) PORTABLE WELL FLUID EXTRACTION APPARATUS

(75) Inventor: Philip W. Eggleston, Sherman, TX (US)

(73) Assignee: Philip W Eggleston, Sherman, TX (US)

( * ) Notice: Subject to any disclaimer, the term of this patent is extended or adjusted under 35 U.S.C. 154(b) by 212 days.

(21) Appl. No.: 11/194,426

(22) Filed: Aug. 1, 2005

(51) Int. Cl.
*E21B 43/00* (2006.01)

(52) U.S. Cl. ..... 166/69; 166/369; 294/68.22

(58) Field of Classification Search ..... 166/67, 166/69, 162, 369, 371; 294/68.22; 417/118
See application file for complete search history.

(56) References Cited

U.S. PATENT DOCUMENTS

| | | | | |
|---|---|---|---|---|
| 1,145,158 | A | 7/1915 | Mapes | |
| 1,372,031 | A | 3/1921 | McKissick | |
| 1,447,992 | A | 3/1923 | Layne et al. | |
| 1,523,604 | A | 1/1925 | Miller | |
| 1,603,675 | A | 10/1926 | Folsom et al. | |
| 2,078,322 | A | 4/1937 | Gage | |
| 2,130,026 | A * | 9/1938 | Purtle et al. | 166/69 |
| 2,145,753 | A | 1/1939 | Coulter | |
| 2,180,864 | A | 11/1939 | Connor | |
| 2,661,697 | A | 12/1953 | Long et al. | |
| 2,965,511 | A | 10/1960 | Morehead | |
| 2,990,780 | A | 7/1961 | Kreuter | |
| 3,034,440 | A | 5/1962 | Hermanson | |
| 3,075,466 | A | 1/1963 | Agnew et al. | |
| 3,113,522 | A | 12/1963 | Coberly | |
| 3,527,298 | A * | 9/1970 | Zerb et al. | 166/162 |
| 3,963,374 | A | 6/1976 | Sullivan | |
| 3,998,568 | A | 12/1976 | Hynd | |
| 4,086,035 | A | 4/1978 | Klaeger, Jr. et al. | |
| 4,439,113 | A | 3/1984 | Owen | |
| 4,583,916 | A | 4/1986 | Senghaas et al. | |
| 4,603,735 | A | 8/1986 | Black | |
| 4,678,040 | A | 7/1987 | McLaughlin et al. | |
| 4,940,088 | A * | 7/1990 | Goldschild | 166/109 |
| 5,028,213 | A | 7/1991 | Dickinson et al. | |
| 6,039,544 | A | 3/2000 | Strickland | |
| 6,216,789 | B1 | 4/2001 | Lorsignol et al. | |
| 6,352,117 | B1 | 3/2002 | Strickland | |
| 6,460,622 | B1 * | 10/2002 | Rice | 166/369 |
| 6,464,012 | B1 | 10/2002 | Strickland | |
| 7,007,751 | B2 * | 3/2006 | Eggleston | 166/162 |
| 2004/0020637 | A1 | 2/2004 | Eggleston | |

* cited by examiner

*Primary Examiner*—David Bagnell
*Assistant Examiner*—David Andrews

(57) ABSTRACT

Well fluid extraction apparatus includes a resiliently downwardly biased discharge head and a canister lowerable from the discharge head into the well to receive fluid therefrom, and then liftable into telescoped engagement with the discharge head. A specially configured seal structure between the discharge head and canister resiliently exerts a downward releasing force on the raised canister to facilitate its subsequent separation from the discharge head. An embodiment of the discharge head is pressure balanced to prevent gas pressure in the well from driving it upwardly. Leveling structure is provided for operatively connecting the apparatus to the vertically sloped upper end of a well casing and vertically leveling the connected apparatus.

14 Claims, 4 Drawing Sheets

PORTABLE WELL FLUID EXTRACTION APPARATUS

BACKGROUND OF THE INVENTION

The present invention generally relates to apparatus useable in conjunction with a subterranean well and, in representatively illustrated embodiments thereof, more particularly provides portable apparatus for extracting fluids, such as oil, gas and water, from a subterranean well.

Disclosed in Applicant's U.S. Pat. No. 7,007,751, the full disclosure of which is hereby incorporated herein by reference, is an apparatus for extracting oil or other fluids from a well. The apparatus is utilizes a fluid retrieval canister which is lowered on a cable into a well to receive well fluid therefrom. Once it receives fluid from the well, the canister is raised by the cable into sealed telescoping engagement with a vertically movable discharge head portion of the overall apparatus and compressed air is forced into the raised canister, via the discharge head, to discharge the received fluid therefrom for transfer to a storage container. The canister is then lowered into the well and the retrieval process is repeated.

While this well fluid extraction apparatus is generally well suited for its intended purpose, in testing of the apparatus it has been discovered that it is in need of improvement in three areas. First, over time the seal structure which sealingly engages the raised canister with the discharge head can become coated with operational contaminants and thereafter tend to cause the canister to hang up in the discharge head and undesirably resist release therefrom for re-lowering of the canister into the well. Second, when the gas pressure in the well is above a certain magnitude (representatively, about 10 psig) such pressure exerts an undesirably high upward force on the upwardly movable discharge head. Third, the apparatus is less than totally satisfactory in wells having vertically tilted upper casing portions to which the apparatus is connected because the connected apparatus is also in a vertically tilted orientation and thus subjects the cable to accelerated wear and stress.

As can be seen from the foregoing, it would be desirable to provide an improved well fluid extraction apparatus, of the general type described, in which these three operational problems are eliminated or at least substantially reduced. It is to this goal that the present invention is primarily directed.

SUMMARY OF THE INVENTION

In carrying out principles of the present invention, in accordance with representatively illustrated embodiments thereof, specially designed apparatus is provided for extracting fluid, such as oil, from a subterranean well having an upper casing end portion which typically projects upwardly from the ground.

The apparatus basically comprises a vessel for receiving fluid from the well, the vessel extending along an axis, and a discharge head structure connectable to an upper portion of the well and useable to remove well fluid from the vessel. A system is provided which is selectively operable to axially lower the vessel into the well, representatively on a cable, to a first position to receive well fluid, and lift the vessel from its first position to a second position in which the discharge head structure and the vessel are forcibly and sealingly engaged for removal of the received well fluid using the discharge head structure.

In one embodiment of the invention, an air compressor is used to force compressed air through the discharge head and into the vessel engaged therewith to force retrieved oil outwardly from the vessel for collection in a suitable retrieval container. In another embodiment of the invention, the inlet of a pump, representatively a peristaltic pump, is connected to the vessel interior, via the discharge head, and is used to draw the retrieved oil out of the container and pump it to the retrieval container.

According to an aspect of the invention, when the vessel is lifted to its second position an upper end portion of the vessel is telescopingly received within the discharge head. A specially designed seal structure creates a peripheral seal between the telescoped vessel and discharge head and has a resilient portion which is compressed in a manner causing the resilient portion to exert both radial and axially upwardly directed forces on the discharge head. The axial force facilitates the release of the vessel portion received in the discharge head when it is desired to re-lower the vessel into the well to retrieve another load of oil. Such axial release force exerted by the seal structure helps to overcome a tendency of the vessel to "hang up" in the discharge head due to operational deposits and debris on the seal structure. Representatively, the seal structure includes at least one O-ring seal carried by an upper end nose portion of the vessel which is telescopingly received within the discharge head when the vessel is raised to its second position, and an annular, convexly curved interior ledge corner within the discharge head which sealingly contacts and deforms the O-ring seal at a downwardly and radially inwardly sloped angle.

According to another aspect of the invention, the discharge head is upwardly movable against a spring biasing force, and the well fluid extraction apparatus is provided with a pressure balancing structure operative to prevent well pressure below the discharge head from exerting an appreciable net upward force on the discharge head. Representatively, the discharge head structure includes a hollow, stationary cylinder, and a piston slidingly and sealingly received in the cylinder for vertical reciprocation relative thereto. The piston has a radially central portion projecting downwardly from said cylinder and adapted to telescopingly engage the vessel, and an annular flange projecting radially outwardly from the radially central portion and being slidably and sealingly received within the interior of the cylinder. The pressure balancing structure includes the piston and a pressure transfer passage for communicating well pressure below the discharge head structure with an interior portion of the cylinder above the annular flange therein. The resulting downward pressure force on the flange offsets the upward pressure force on the balance of the piston. The flange has a peripheral seal slidingly engaging an interior side portion of the cylinder. Preferably, the pressure balancing structure further includes a pressure relief passage for venting to atmosphere pressure leaking downwardly past this peripheral seal.

According to a further aspect of the invention, the well fluid extraction apparatus is provided with connection and leveling structure for operatively securing the well fluid extraction apparatus to the upper casing end portion in a sealed, selectively variable pivotal orientation relative to a horizontal axis to maintain the discharge head axis in a precisely vertical orientation even though the axis of the upper casing end portion is tilted away from vertical. Representatively the connection and leveling structure includes a connection flange having a tubular central body portion threadable onto the upper casing end, and a leveling flange anchored to a tubular member in which the discharge head is sealingly disposed. An annular, flat chamfered sealing surface is formed on the underside of the leveling flange and is slidingly and sealingly engageable with a radiused annular surface formed on the upper end of the tubular central body portion of the connection flange and sloping downwardly and radially outwardly. When the curved and chamfered annular surfaces engage each other, the well fluid extraction apparatus may be tilted as necessary about a horizontal axis to bring the discharge head axis to a precisely vertical orientation, despite a tilting away from vertical of the casing upper end portion axis, and locked in this precisely vertical orientation by simply tightening bolts extending through aligned peripheral portions of the connection and leveling flanges.

DETAILED DESCRIPTION

Figure 1:
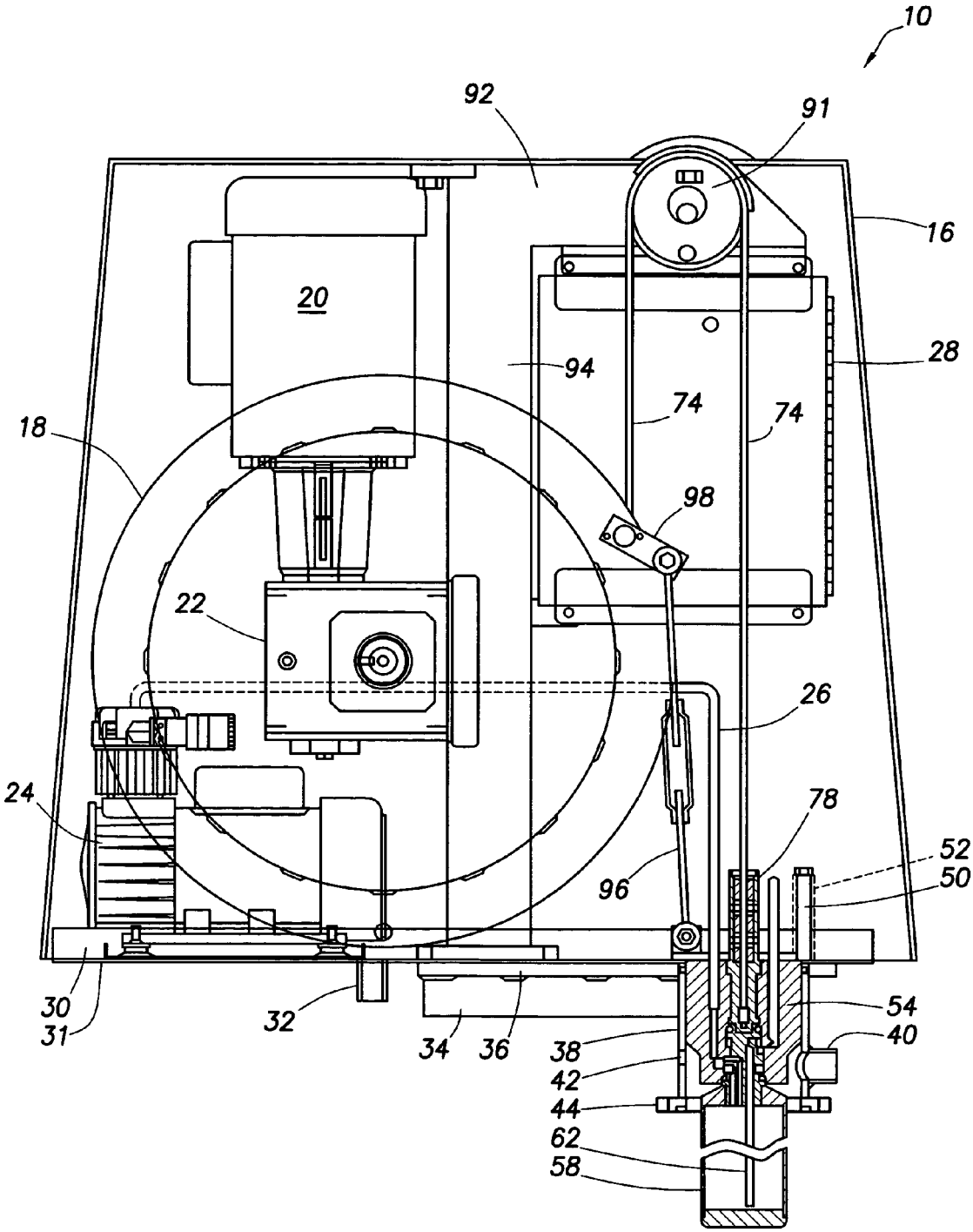
FIG. 1 is a simplified, somewhat schematic cross-sectional view through a portable well fluid extraction apparatus embodying principles of the invention.
Figure 2:
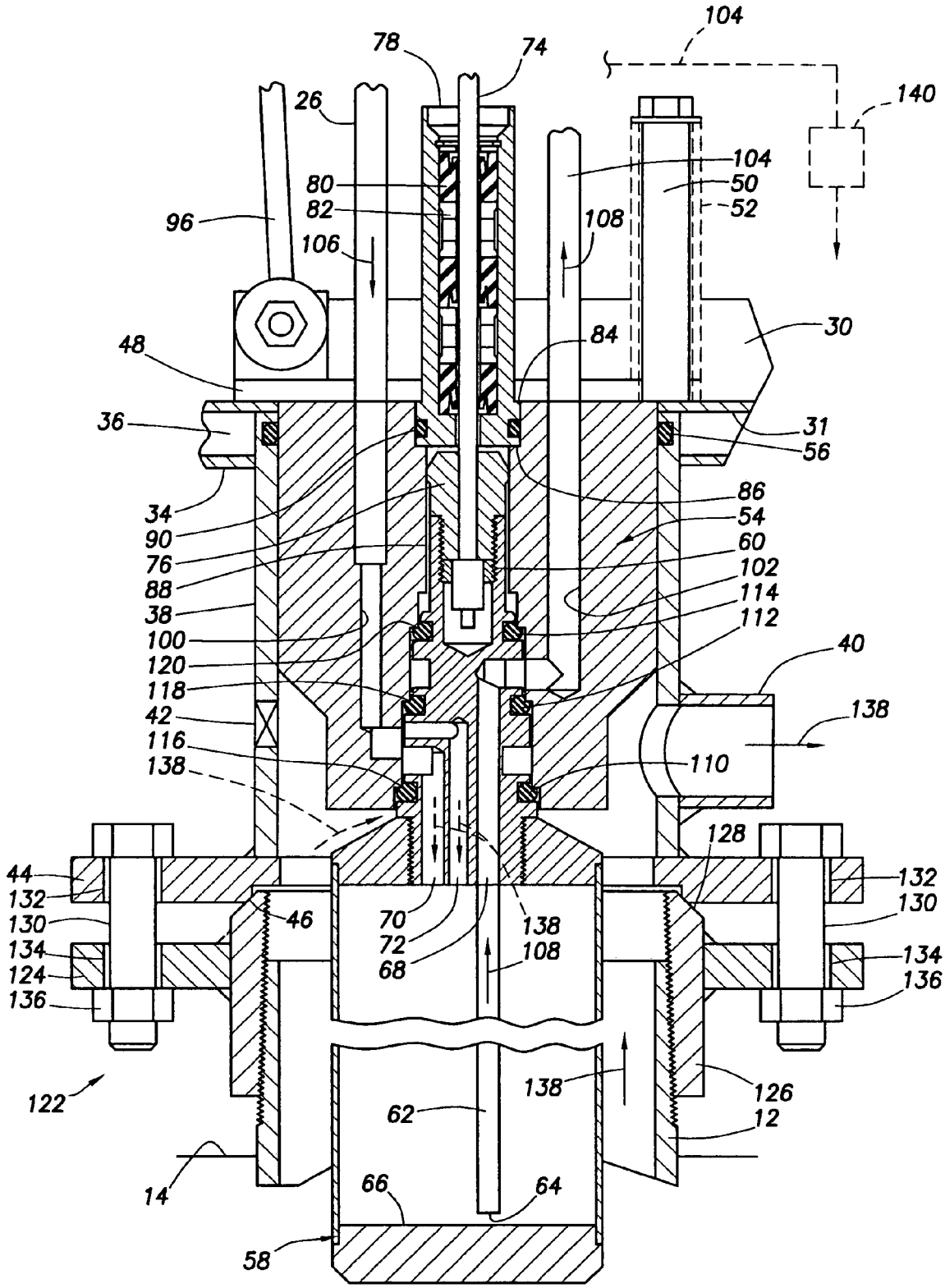
FIG. 2 is an enlarged scale cross-sectional view through a retrieval canister/discharge head portion of the apparatus.

Referring initially to FIGS. 1 and 2, in a first embodiment thereof the present invention provides a portable well fluid extraction apparatus 10 (see FIG. 1) for extracting fluid, such as oil, from a subterranean well representatively having an upper casing end portion 12 (see FIG. 2) projecting upwardly from the ground 14. The portable apparatus 10, which may be easily transported to and from the well site in the bed of a pickup truck, includes a housing 16 in which a reel 18 is supported for selectively driven rotation by an electric motor 20 connected to the reel 18 through a gearbox 22. An electrically driven air compressor 24 having a discharge line 26 connected to its outlet is supported within a bottom portion of the housing 16 and, like the electric motor 20, is controlled by various conventional electrical components (not shown) within an electrical control box 28 in the housing 16.

A drainage pan 30 having a bottom side wall 31 horizontally extends along an interior bottom portion of the pan for collecting fluid which may drip from various of the components within the housing 16, the bottom side wall 31 of the pan 30 having a suitable drain fitting 32 connected thereto. A horizontal base structure 34, having a top plate portion 36, is anchored to the housing 16 directly beneath the pan 30, and the open upper end of a vertical pipe member 38 is welded to the underside of the top plate portion 36. The side wall portion of the pipe member 38 has a smaller transverse gas discharge pipe 40 welded thereto and a schematically depicted pressure relief valve 42 installed therein. An annular leveling flange 44 is coaxially welded to the bottom end of the pipe member 38 and has, on its bottom side, an annular radially inner surface portion 46 (see FIG. 2) having, around its periphery, a flat chamfered configuration.

Disposed on the top side of the bottom pan wall 31 and overlying the open upper end of the vertical pipe member 38 is a rectangular discharge plate 48. Four vertical bolts 50 (only one of which is visible in FIGS. 1 and 2) slidably extend downwardly through corner openings in the plate 48 and are threaded at their lower ends into the base structure top plate portion 36. Coiled compression springs 52 coaxially encircle and are captively retained on the bolts 50 and serve to resiliently bias the discharge plate 48 downwardly into contact with the top side of the bottom pan wall 31 and yieldingly permit the discharge plate 48 to be moved upwardly away from the pan wall 31.

A hollow, generally tubularly configured discharge head structure 54 is coaxially and slidably received in the interior of the vertical pipe member 38 and is sealed therein by an O-ring seal 56 interiorly carried by the pipe member 38. The upper end of the discharge head 54 is bolted to the bottom side of the discharge plate 48 so that the discharge head 54 is vertically movable with the plate 48. As can be seen in FIG. 2, the plate 48 acts as a vertical stop to prevent further downward movement of the discharge head 54 from its FIG. 2 lower limit position in which the bottom side of the plate 48 downwardly abuts the bottom side wall 31 of the pan 30.

A well fluid retrieval vessel, in the form of a vertically elongated hollow cylindrical canister 58 having a reduced diameter radially stepped cylindrical upper end nose portion 60, underlies the discharge head 54. Extending vertically through the interior of the canister 58 is a fluid delivery tube 62 having an open lower end 64 upwardly adjacent the bottom interior end surface 66 of the canister 58. The open upper end of the tube 62 communicates with a vertical discharge passage 68 extending through the nose 60 and opening horizontally outwardly through its side surface. For purposes later described herein, nose 60 also has formed vertically therethrough fill and vent passages 70,72 which communicate at their lower ends with the interior of the canister 58 and have upper end portions that open outwardly through the side surface of the nose 60.

An upper end portion of the nose 60 receives and is locked to the lower end of a raising and lowering cable 74 by a connector structure 76 surrounding the lower cable end and threaded into the open upper end of the nose 60. From its juncture with the main seal structure 76, the cable 74 slidably extends upwardly through a vertically elongated tubular packing box 78 with vertically alternating annular wiper seals 80 and spacing structures 82 disposed therein. As best illustrated in FIG. 2, a lower end of the packing box 78 is captively retained between facing annular horizontal ledges 84,86 respectively formed on the discharge plate 48 and the central passage 88 extending vertically through the discharge head 54. The lower end of the packing box 78 carries an O-ring seal 90 which exteriorly seals the lower packing box end within an upper end portion of the central discharge head passage 88.

From the top end of the packing box 78, the cable extends upwardly around a rotatable pulley 91 (see FIG. 1) mounted on a horizontal arm portion 92 of a generally inverted L-shaped support post member 94, disposed within the apparatus housing 16, and then winds around the motor-driven reel 18. For purposes later described herein, an axially movable, vertically extending rod linkage 96 is anchored at a lower end thereof to the discharge plate 48, and rotatably connected at an upper end thereof to a pivotally supported limit switch arm 98 (see FIG. 1).

With the important exceptions noted below, the well fluid extraction apparatus 10 depicted in FIGS. 1 and 2 operates in a manner similar to the operation of the well fluid extraction apparatus embodiment shown in FIG. 3A of my copending U.S. application Ser. No. 10/443,353, with the following being a brief description of the apparatus 10 in the present application. For a more complete operational description, reference is hereby made to such copending application.

Basically, to retrieve well fluid from the well of which the illustrated upper casing end portion 12 is a part, the extraction apparatus is coupled to the upper casing end 12 as later described herein, and the motor 20 is operated to lower the canister 58 from its illustrated upper limit (or "docked") position downwardly through the casing into the well until the canister 58 is immersed in oil. The oil then flows into the canister interior through its fill passage 70, with the filling of the canister 58 with oil being facilitated by the canister vent passage 72. After the canister 58 is filled with oil, the motor 20 is operated to lift the oil-filled canister 58 back to its illustrated upper limit position in which its nose portion 60 is telescopingly received in the central discharge head passage 88 and sealed therein in a novel manner subsequently described herein.

With primary reference now to FIG. 2, then the nose portion 60 of the canister 58 is pulled by the cable 74 into the central discharge head passage 88, the upward cable pull drives the discharge head 54 and the discharge plate 48 upwardly away from their FIG. 2 normal position against the downward biasing force of the bolt springs 52. In response to such upward movement of the discharge head 54 and discharge plate 48, the rod linkage 96 is also axially moved upwardly which in turn pivots the limit switch arm 98 (see FIG. 1) in a counterclockwise direction to thereby cause a limit switch (not shown) in the control box 28 to de-energize the motor 20 and terminate driven rotation of the reel 18.

With the oil-filled canister 58 brought back to this upper limit position, a first vertical flow passage 100 in the discharge head 54 communicates the canister fill and vent passages 70,72 with the compressor discharge line 26, and a second vertical flow passage 102 in the discharge head 54 communicates the canister discharge passage 68 with an oil flow line 104 coupled to a suitable extracted oil-receiving container (not illustrated). The compressor 24 is then energized to force compressed air 106 through the compressor discharge line 26, downwardly through the discharge head passage 100 and into the interior of the canister 58 via its fill and vent passages 70,72. Compressed air entering the canister interior sequentially drives the oil 108 therein upwardly through the canister fluid delivery tube 62, through the canister and discharge passages 68 and 102, and outwardly through the oil flow line 104 and into the extracted oil-receiving container to which it is connected. The canister's above-described lowering, raising and oil extraction cycle is then repeated as required.

According to a key aspect of the present invention, specially designed cooperating seal structures are incorporated into the discharge head 54 and the canister nose 60 and uniquely facilitate the downward release of the canister 58 from the discharge head 54, so that the canister 58 can be re-lowered into the well, even if operational deposits on the facing telescoped discharge head and canister nose would otherwise tend to cause the canister nose 60 to "hang up" within the discharge head 54.

As can be seen in FIG. 2, the cylindrical canister nose 60 has, along its vertical length, a radially stepped configuration in which each successively higher axial section of the nose 60 has a smaller diameter than the preceding axial section. Representatively, there are three such radial dimension reductions on the illustrated nose 60. The lower three axial sections of the nose 60 have annular grooves formed therein which respectively carry a lower resilient O-ring seal 110, a vertically intermediate O-ring seal 112, and an upper O-ring seal 114. When the canister nose 60 is telescopingly received in the discharge head 54 as illustrated in FIG. 2, the seals 110,112,114 are respectively contacted and resiliently deformed by rounded annular corner portions 116,118,120 of the indicated interior annular ledge portions of the discharge head 54. These rounded annular corner portions 116,118,120 engage their associated O-ring seals 110,112, 114 at downwardly and radially inwardly inclined angles, representatively of about 45 degrees, to form annular point contact seals therewith.

Because the O-ring seals 110,112,114 are carried on the canister nose 60 instead of being carried within the interior of the discharge head 54, both the nose 60 and the discharge head 54 may conveniently be of one piece constructions. Additionally, and quite importantly, because the interior rounded corner portions 116,118,120 of the discharge head 54 contact the O-ring seals 110,112,114 at downwardly and radially inwardly inclined angles, the deformed O-ring seals exert not only radially outwardly directed resilient sealing forces on the discharge head 54, but exert resilient downwardly directed forces on the canister nose 60. When it is desired to lower the raised canister 58 back into the well, and the upward cable force is lessened, this downwardly directed seal force exerted on the canister 58 helps to downwardly release it from the discharge head 54 and avoid canister "hang ups" therein which might otherwise occur due to operational deposits on the O-ring seals.

Because a cable is being used to lower and raise the canister 58 into and out of the well, it is desirable that the central axis of the cylindrical discharge head structure 54, when connected to the upper end of the well casing 12, be as precisely vertical as possible to avoid chafing the cable as it is being raised and lowered. However, it is often the case that the axis of the upper casing end 12 is substantially tilted away from vertical. To essentially eliminate this potential extraction apparatus mounting problem, the present invention provides a specially constructed mounting and leveling apparatus 122 which will now be described in conjunction with FIG. 2.

The mounting and leveling apparatus 122 includes the previously described annular leveling flange 44, and an annular mounting flange 124 that coaxially circumscribes an internally threaded annular mounting collar or tubular central body portion 126 having, around its upper end, an annular convexly radiused surface 128 which slopes downwardly and radially outwardly (representatively at a 45 degree angle) around its periphery. The radiused surface 128 is preferably a segment of a spherical surface centered on the central vertical axis of the flanges 44 and 124.

To operatively mount the extraction apparatus 10 on the upper casing end portion 12, the collar 126 is first threaded onto the upper casing end portion 12 as shown. Next, the annular flat chamfered surface 46 of the leveling flange 44 is placed atop the radiused surface 128, with the surface 46 being tangent to the surface 128, and bolts 130 are extended downwardly through aligned holes 132,134 in the flanges 44,124 and threaded into nuts 136. By appropriately rocking the apparatus 10 about a horizontal axis, to bring the axis of the discharge head 54 to a precisely vertical orientation, and then tightening the bolts 130, the axis of the discharge head 54 may be maintained in a precisely vertical orientation despite the fact that the axis of the upper casing end portion 12 is tilted away from vertical. The forcible engagement between the flat chamfered annular surface 46 and the radiused surface 128 creates an annular seal area therebetween which prevents gas outflow from the well through the at the juncture between the surfaces 46 and 128. While the surface 46 is preferably a flat chamfered surface, it could alternatively be an annular edge contact surface, or a rounded annular contact surface, and still create the desired seal with the surface 128.

By virtue of the various sealing elements described above, pressurized gas 138 within the well may be produced, by flowing it outwardly through the gas discharge pipe 40 to a suitable receiving container (not shown), at the same time that the apparatus 10 is extracting oil 108 from the well. With the apparatus 10 shown in FIGS. 1 and 2, it is not necessary to vent the gas 138 to atmosphere during the described oil extraction process.

Instead of using the air compressor 24 to blow oil 108 out of the canister 58 when it is docked to the discharge head 54, a pump such as, for example, the peristaltic pump 140 illustrated in phantom in FIG. 2, may be utilized to extract oil 108 from the canister 58. To do this, the lower O-ring seal 110 is removed, the inlet to the discharge head flow passage 100 is suitably blocked, and the oil flow line 104 is coupled to the inlet of the pump 140 as indicated in phantom in FIG. 2. With the canister 58 docked to the discharge head 54, the pump 140 is started to draw the oil 108 in the canister 58 into the pump 140 for discharge therefrom into a suitable receiving container (not shown). During operation of the pump 140, gas 138 within the well is permitted to be drawn into the canister 58, through its fill and vent passages 70 and 72 as illustrated in phantom in FIG. 2, via the seal area vacated by the removal of the lower O-ring seal 110.

Figure 3:
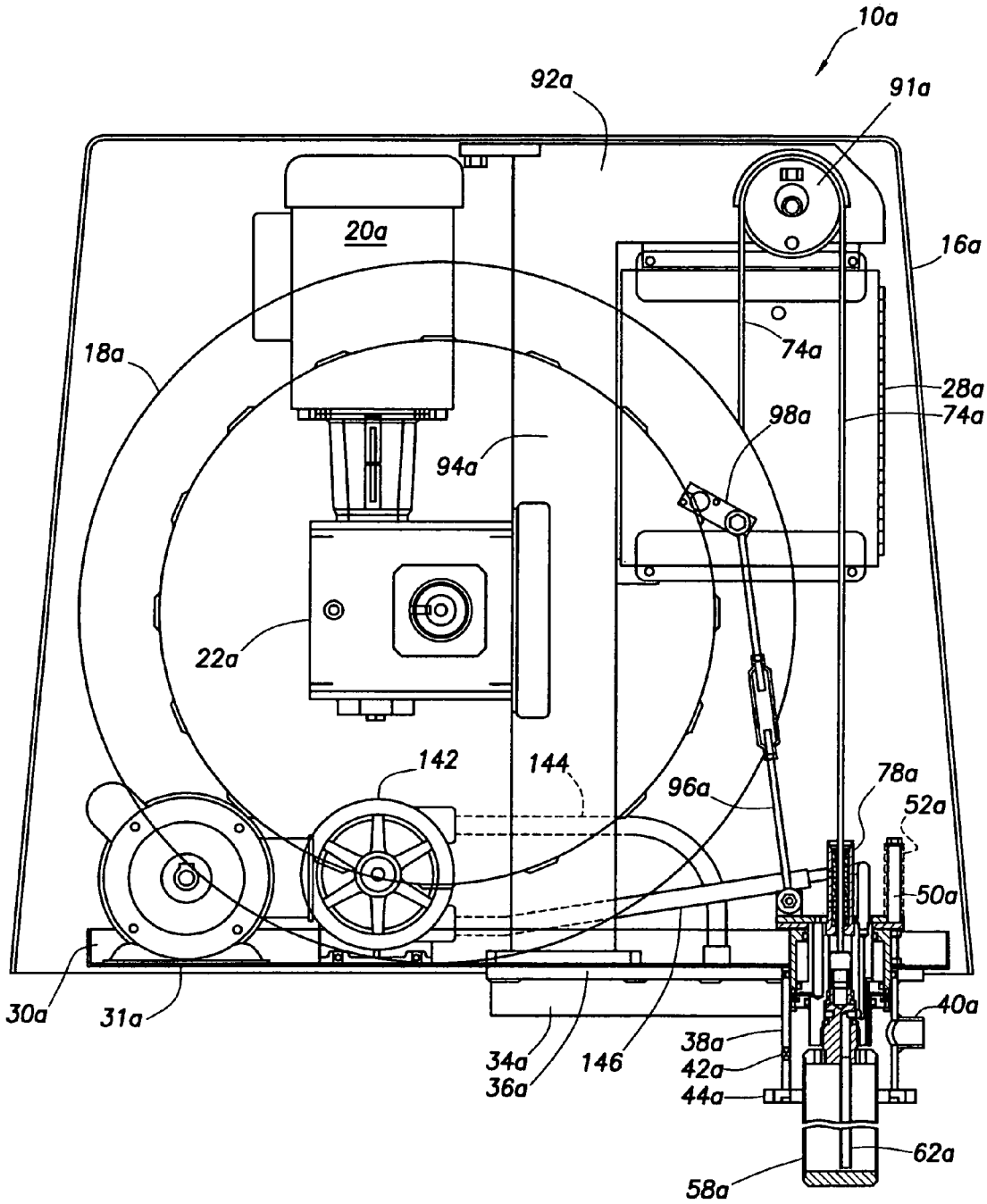
FIG. 3 is a simplified, somewhat schematic cross-sectional view through an alternate embodiment of the portable well fluid extraction apparatus.
Figure 4:
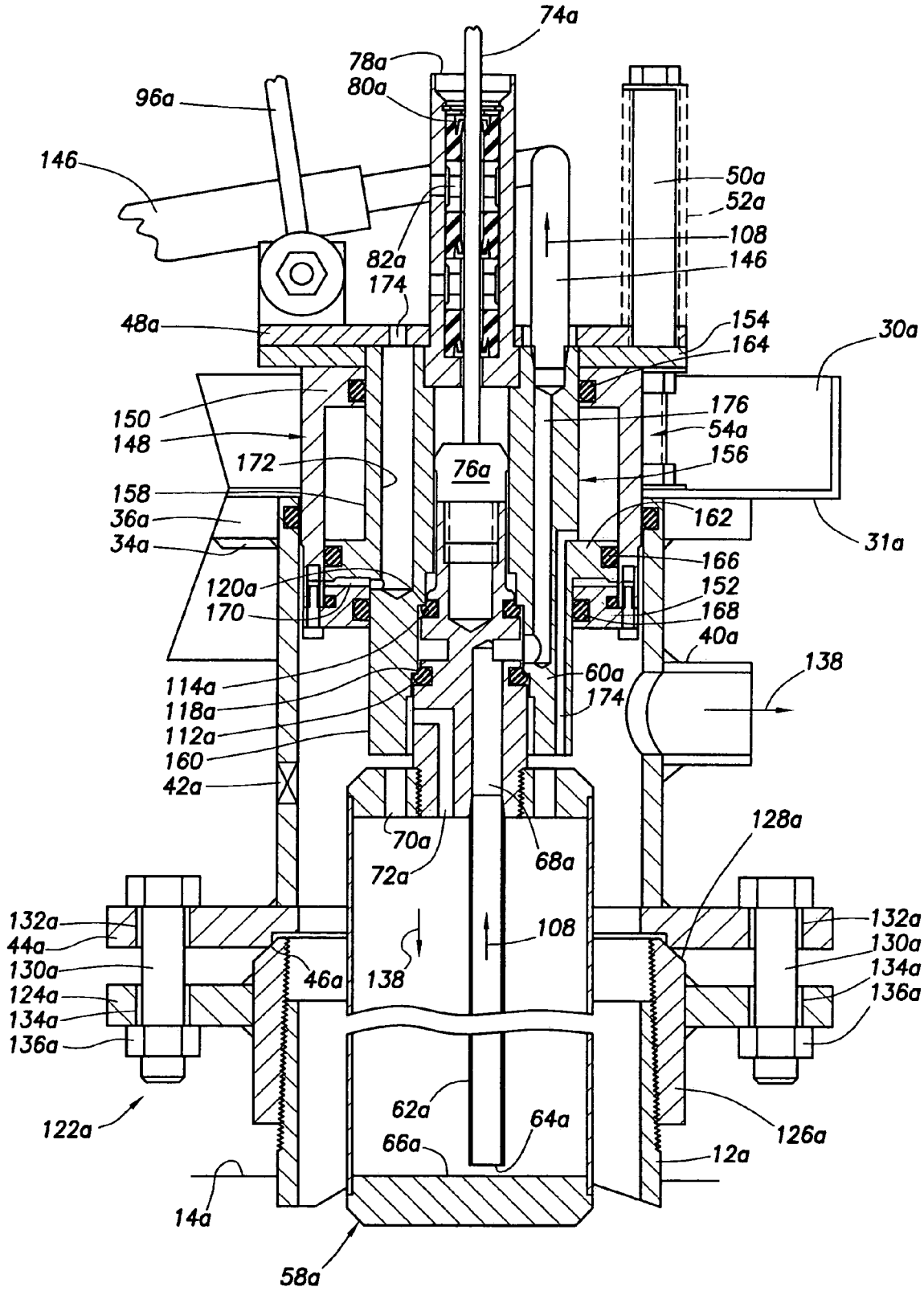
FIG. 4 is an enlarged scale cross-sectional view through a retrieval canister/discharge head portion of the FIG. 3 apparatus.

An alternate embodiment 10*a* of the well fluid extraction apparatus 10 previously described in conjunction with FIGS. 1 and 2 is illustrated in FIGS. 3 and 4. To facilitate the ready comparison between apparatus 10 and apparatus 10*a*, components in apparatus 10*a* similar to those in apparatus 10 have been given identical reference numerals to which the subscripts "a" have been added.

As can be seen in FIG. 3, in the extraction apparatus 10*a*, the air compressor 24 (see FIG. 1) is not used, but instead is replaced by a pump, representatively a peristaltic pump 142. Pump 142 has a discharge line 144 through which extracted oil is delivered to a suitable receiving container (not shown), and an inlet line 146. Moreover, as will be subsequently described herein, the discharge head structure 54*a* is provided with a unique "pressure balanced" configuration, and the configuration of the canister 58*a* is slightly altered.

In the previously described well fluid extraction apparatus 10, during use of the apparatus pressurized gas within the well exerts an upward pressure force on the underside of the vertically movable discharge head 54 (see FIG. 2). This upward pressure force is resisted by the bolt springs 52. When the gas pressure within the well is 10 psig or below, the springs 52 are able to hold the discharge head 54 in its lower limit position. However, when the gas pressure within the well is substantially greater than 10 psig, this excess pressure is relieved by the previously mentioned relief valve 42. As will now be described, the pressure balanced discharge head structure 54*a* uniquely utilizes the well gas pressure to substantially prevent any net upward well pressure force from being imposed on the discharge head 54*a*.

The discharge head 54*a* includes a tubular cylinder structure 148 having an open upper end bordered by an inturned annular flange 150, and an open lower end to which an annular end plate 152 is coaxially and removably secured. The upper end of the cylinder structure 148 is anchored to a stationary plate 154 that underlies the vertically movable discharge plate 48*a*.

A hollow tubular pressure balancing piston 156 slidably mounted in the cylinder 148 for vertical reciprocating motion relative thereto. Piston 156 has a tubular upper end portion 158, a tubular lower end portion 160, and a vertically intermediate outwardly projecting annular flange portion 162 having a top side annular surface area. The upper piston portion 158 is slidingly and sealingly engaged within the cylinder 148 by an O-ring seal 164 carried by the upper cylinder flange 150, and the upper end of the upper piston portion 158 extends through an opening in the plate 154 and is anchored to the discharge plate 48*a* for vertical movement therewith. An O-ring seal 166 carried by the piston flange 162 slidingly and sealingly engages the interior side surface of the cylinder 148, and an O-ring seal 168 carried by the annular end plate 152 slidably and sealingly engages the lower piston end portion 160.

Positioned vertically between the piston flange 162 and the annular end plate 152 is an annular vent clearance space 170 communicating with a vertical vent passage 172 extending upwardly through the upper piston end portion 158 and opening outwardly through a hole 174 in the stationary plate 154. A vertical pressure transfer passage 174 extends upwardly through the bottom end of the piston 148 and communicates with the interior of the cylinder 148, and an oil transfer passage 176 extends upwardly through the interior of the piston 148 and communicates at its upper end with the pump inlet line 146.

The canister 58*a* has fill and vent passages 70*a* and 72*a*, but is not provided with the lowermost O-ring seal 110 incorporated into the previously described extraction apparatus 10. The two O-ring seals 112*a*,114*a* carried by the nose 60*a* are contacted by the corresponding annular interior corner portions 118*a*,120*a* of the piston portion 148 of the discharge head structure 54*a*. When the canister nose 60*a* is telescopingly and sealingly received within the piston portion 148 of the discharge head structure 54*a*, the discharge passage 68*a* within the nose 60*a* communicates with the oil transfer passage 176 within the piston 148. To retrieve oil 108 contained in the docked canister 58*a* the pump 142 (see FIG. 3) is started to sequentially draw oil 108 upwardly through the canister tube 62*a*, the nose and piston passages 68*a* and 176, through the pump inlet line 146, and then through the pump 142 and its discharge line 144 into the receiving container (not shown).

As oil 108 is being extracted from the docked canister 58*a*, gas 138 is permitted to be drawn into the canister interior, via the canister's fill and vent passages 70*a* and 72*a*, to prevent a vacuum from being created within the canister 58*a*. At the same time, gas 138 is being produced from the well via the gas discharge pipe 40*a*.

Due to the specially designed pressure balanced construction of the discharge head structure 54*a*, the gas pressure within the well does not exert an appreciable net upward force on the discharge head structure 54*a* which would tend to compress the bolt springs 52*a*. This is due to the fact that well gas pressure from below the discharge head structure 54*a* is transmitted upwardly into the interior of the cylinder 148, to exert a pressure force on the top side surface of the piston flange 162, via the pressure transfer passage 174 in the piston 148.

This downwardly directed pressure force on the piston flange 162 tends to drive the piston 156, and thus the discharge plate 48*a*, downwardly toward their lower limit positions shown in FIG. 4 to thereby prevent gas pressure within the well from exerting compressive force on the bolt springs 52*a*. To assure that such well gas pressure exerts no appreciable net upward force on the discharge head structure 54*a*, the annular surface area of the top side of the piston flange 162 is sized to be equal to or greater than the area of a circle having a diameter equal to the outer diameter of the lower end portion 160 of the piston 156.

The vent passages 170,172 serve to prevent gas pressure leaking downwardly past the piston flange seal 166 from exerting an upward pressure force on the piston flange 162. In the event that such seal leakage occurs, pressurized gas from above the piston flange 162 that passes downwardly past the seal 166 is simply vented to atmosphere (via the passages 170,172 and the plate hole 174) without exerting an upwardly directed pressure force on the piston flange 162.

The foregoing detailed description is to be clearly understood as being given by way of illustration and example only, the spirit and scope of the present invention being limited solely by the appended claims.

What is claimed is:

1. Apparatus for extracting fluid from a subterranean well, comprising:

a vessel for receiving fluid from the well, said vessel extending along an axis;

a discharge head structure connectable to an upper portion of the well and useable to remove well fluid from said vessel, wherein said discharge head structure telescopingly receives an upper axial portion of said vessel when said vessel is in said second position, and said resilient portion of said seal apparatus is externally carried on and coaxially circumscribes said upper axial portion of said vessel;

a system selectively operable to axially lower said vessel into the well to a first position to receive well fluid, and lift said vessel from said first position to a second position in which said discharge head structure and said vessel are forcibly interengaged in a telescoped relationship for removal of the received well fluid using said discharge head structure; and a seal apparatus for creating a peripheral seal between telescoped portions of said discharge head structure and said vessel, said seal apparatus having a resilient portion which, with said vessel in said second position, resiliently biases said vessel axially toward said second position to facilitate release of said vessel from said discharge head structure.

2. The apparatus of claim 1 wherein: said upper portion of said vessel has a generally cylindrical cross-section with an annular exterior peripheral groove circumscribing said axis, said resilient portion of said seal apparatus includes a resilient o-ring seal member carried in said groove and having an annular, radially outer portion projecting laterally outwardly from said groove, and said seal apparatus includes an annular interior corner portion of said discharge head structure that engages said annular, radially outer portion of said o-ring seal member, and compresses it in both axial and radial directions, when said vessel is in said second position thereof.

3. The apparatus of claim 2 wherein: said annular interior corner portion has a concavely rounded configuration.

4. The apparatus of claim 1 wherein: said system includes a pump having an inlet communicatable with the interior of said vessel via telescoped portions of said discharge head structure and said vessel, said pump being operative to draw received well liquid out of said vessel for external retrieval of the received well liquid.

5. The apparatus of claim 4 wherein: said pump is a peristaltic pump.

6. Apparatus for extracting fluid from a subterranean well, comprising:

a vessel for receiving fluid from the well, said vessel extending along an axis;

a discharge head structure connectable to an upper portion of the well and useable to remove well fluid from said vessel;

a system selectively operable to axially lower said vessel into the well to a first position to receive well fluid, and lift said vessel from said first position to a second position in which said discharge head structure and said vessel are forcibly and sealingly engaged for removal of the received well fluid using said discharge head structure; and pressure balancing structure, wherein said pressure balancing structure utilizes well pressure directed against a portion of said discharge head structure to prevent well pressure below said discharge head structure from exerting an appreciable net upward force on said discharge head structure.

7. The apparatus of claim 6 wherein: said portion of said discharge head structure is an axially movable portion thereof.

8. The apparatus of claim 6 wherein: said discharge head structure includes a hollow, stationary cylinder, and a piston slidingly and sealingly received in said cylinder for vertical reciprocation relative thereto, said piston having a radially central portion projecting downwardly from said cylinder and adapted to telescopingly engage said vessel, and an annular flange projecting radially outwardly from said radially central portion and being slidably and sealingly received within the interior of said cylinder, and said pressure balancing structure includes said piston and a pressure transfer passage for communicating well pressure below said discharge head structure with an interior portion of said cylinder above said annular flange.

9. The apparatus of claim 8 wherein: said flange has a peripheral seal slidingly engaging an interior side portion of said cylinder, and said pressure balancing structure further includes a pressure relief passage for venting to atmosphere pressure leaking downwardly past said peripheral seal.

10. The apparatus of claim 8 further comprising:

a discharge plate disposed externally above and anchored to an upper end portion of said piston for vertical movement therewith; and biasing structure for resiliently biasing said discharge plate downwardly toward a lower limit position thereof.

11. Well fluid extraction apparatus, comprising:

a vessel for receiving fluid from a subterranean well having an upper casing end portion;

a discharge head structure extending along a vertically orientable axis and useable to remove well fluid from said vessel;

a system selectively operable to lower said vessel into the well to a first position to receive well fluid, and lift said vessel from said first position to a second position in which said discharge head and said vessel are forcibly and sealingly engaged for removal of the received well fluid using said discharge head structure;

connection and leveling structure for operatively securing said well fluid extraction apparatus to the upper casing end portion in a sealed, selectively variable orientation therewith about a horizontal axis to maintain said discharge head axis in a precisely vertical orientation even though the axis of the upper casing end portion is tilted away from vertical, wherein said connection and leveling structure further includes:

a first flange structure securable to the upper casing end portion, a second flange structure, an annular, convexly curved surface carried by said first flange structure, an annular chamfered surface carried by said second flange structure; and fastening structure for connecting said first and second flange structures in selectively variable relative angular orientations in which said convexly curved and chamfered annular surfaces are sealingly engaged with one another;

a tubular member having an upper end portion in which said discharge head structure is sealingly disposed, and a lower end portion, said second flange structure being secured to said lower end portion of said tubular member.

12. The well fluid extraction apparatus of claim 11 wherein:

said first flange structure is threadable onto the upper casing end portion.

13. The well fluid extraction apparatus of claim 11 wherein: said annular convexly curved surface formed on said first flange structure is sloped downwardly and radially outwardly.

14. The well fluid extraction apparatus of claim 13 wherein:

said first flange structure has a tubular central body portion threadable onto the upper casing end portion, said annular convexly curved surface being formed on an upper end of said central body portion.

* * * * *